US007246732B1

(12) United States Patent
Ha

(10) Patent No.: US 7,246,732 B1
(45) Date of Patent: Jul. 24, 2007

(54) MODEL DISPLAY STAND SYSTEM

(76) Inventor: Simon Ha, 35 Soho Cres, Markham, Ont (CA) L3P 7H9

( * ) Notice: Subject to any disclaimer, the term of this patent is extended or adjusted under 35 U.S.C. 154(b) by 0 days.

(21) Appl. No.: 10/164,777

(22) Filed: Jun. 7, 2002

(51) Int. Cl.
*B60R 7/06* (2006.01)

(52) U.S. Cl. ..... 224/483; 224/282; 224/552; 224/553; 248/176.1; 248/425

(58) Field of Classification Search ..... 224/483, 224/282, 42.32, 42.4, 42.36, 552, 553, 555, 224/559; 248/415, 417, 425, 430, 186.2, 248/176.1, 177.1, 183.3; 446/7, 435, 465
See application file for complete search history.

(56) References Cited

U.S. PATENT DOCUMENTS 2,564,213 A * 8/1951 Redhead ..... 40/413
2,910,260 A 10/1959 Tanner
3,467,350 A 9/1969 Tyler
3,861,638 A * 1/1975 Tong ..... 248/407
4,617,430 A 10/1986 Bryant
4,988,065 A 1/1991 Leban et al.
5,163,647 A 11/1992 Fader et al.
5,601,490 A * 2/1997 Nakagawa et al. ..... 463/63
5,611,432 A * 3/1997 Dods ..... 206/461
D394,646 S 5/1998 Ratzlaff
5,865,516 A * 2/1999 Woy ..... 312/125
6,581,892 B2 * 6/2003 Carnevali ..... 248/276.1
6,634,532 B1 * 10/2003 Maguire ..... 224/483

* cited by examiner

*Primary Examiner*—Nathan J. Newhouse
(74) *Attorney, Agent, or Firm*—Leonard & Proehl, Prof. LLC

(57) ABSTRACT

A model display stand system includes a platform portion that is designed to be coupled to the dashboard of the vehicle. The platform portion is designed for receiving the model such that the platform portion is designed for supporting the model above the dashboard of the vehicle. A frame assembly is pivotally coupled to the platform portion. The frame assembly is designed for selectively engaging the rear wheels of the model such that the frame assembly is designed for permitting the model to pivot with respect to the platform portion when the vehicle is turning. A steering assembly is pivotally coupled to the frame assembly. The steering assembly is designed to be coupled to the front wheels of the model. The steering assembly is designed for pivoting the front wheels of the model to correspond to the front wheels of the vehicle when the vehicle is turning.

20 Claims, 8 Drawing Sheets

MODEL DISPLAY STAND SYSTEM

BACKGROUND OF THE INVENTION

1. Field of the Invention

The present invention relates to model display stands and more particularly pertains to a new model display stand system for fulfilling a need for a self-adjusting model stand for vehicle interiors.

2. Description of the Prior Art

The use of model display stands is known in the prior art. U.S. Pat. No. 2,910,260 describes a swivel stand for supporting model airplanes at various angles to simulate the orientation of an airplane in flight. Another type of model display stand is U.S. Pat. No. 5,163,647 describing a universal fulcrum for mounting an object such as a model airplane, on a supporting surface such as an upstanding rod. U.S. Pat. No. 4,988,065 describes a mounting device for an ornamental object to a surface of vehicles. U.S. Pat. No. 4,617,430 describes a swivel mounting base that utilizes a locking screw with a spherical nut to permit lock-in of a mounting surface at a desired position relative a mounting base. U.S. Pat. No. 3,467,350 describes a vibration damping mount for mounting an instrument such as a camera. U.S. Pat. No. Des. 394,646 describes an ornamental design for a monitor stand.

While these devices fulfill their respective, particular objectives and requirements, the need remains for a device provides a stand for a model which allows the model to mimic the vehicle.

SUMMARY OF THE INVENTION

Another object of the present invention is to provide a new model display stand system that provide a conversation piece for drivers and passengers while traveling in a vehicle.

Still another object of the present invention is to provide a new model display stand system that be simple to use, affordable, and self-adjusting.

To this end, the present invention generally comprises a platform portion that is designed to be coupled to the dashboard of the vehicle. The platform portion is designed for receiving the model such that the platform portion is designed for supporting the model above the dashboard of the vehicle. A frame assembly is pivotally coupled to the platform portion. The frame assembly is designed for selectively engaging the rear wheels of the model such that the frame assembly is designed for permitting the model to pivot with respect to the platform portion when the vehicle is turning. A steering assembly is pivotally coupled to the frame assembly. The steering assembly is designed to be coupled to the front wheels of the model. The steering assembly is designed for pivoting the front wheels of the model to correspond to the front wheels of the vehicle when the vehicle is turning.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
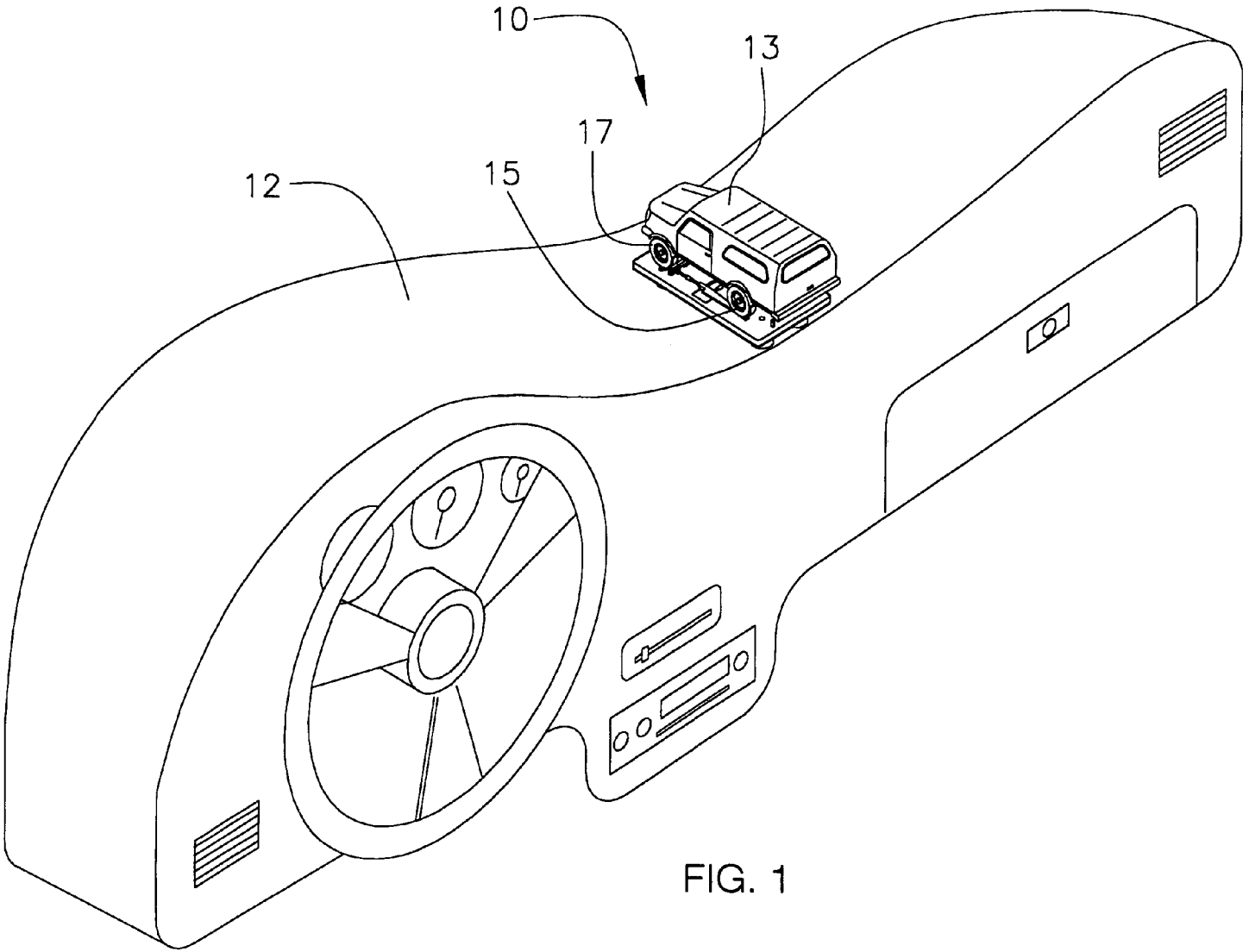
FIG. 1 is a in-use perspective view of a new model display stand system according to the present invention.
Figure 2:
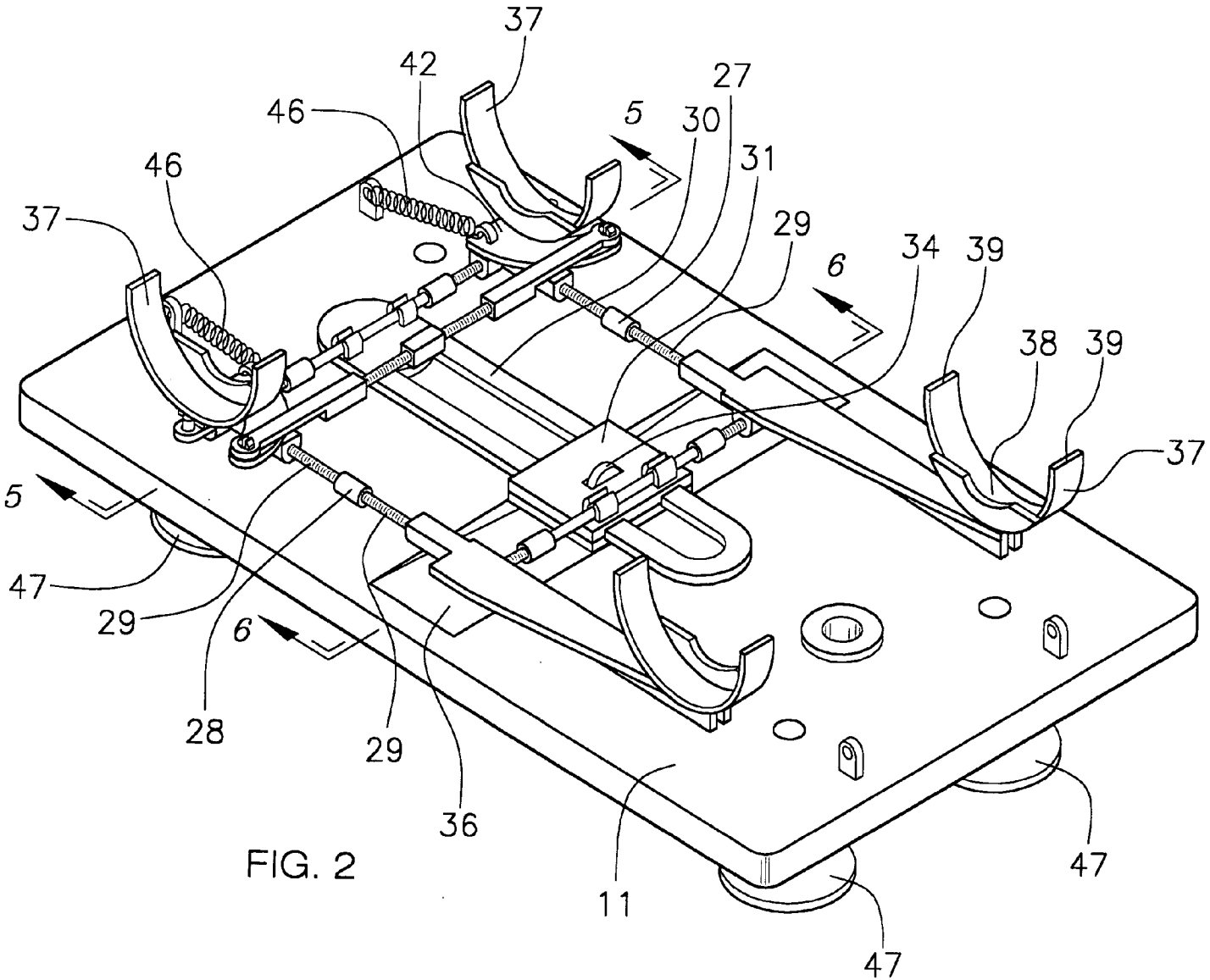
FIG. 2 is a perspective view of the present invention.
Figure 3:
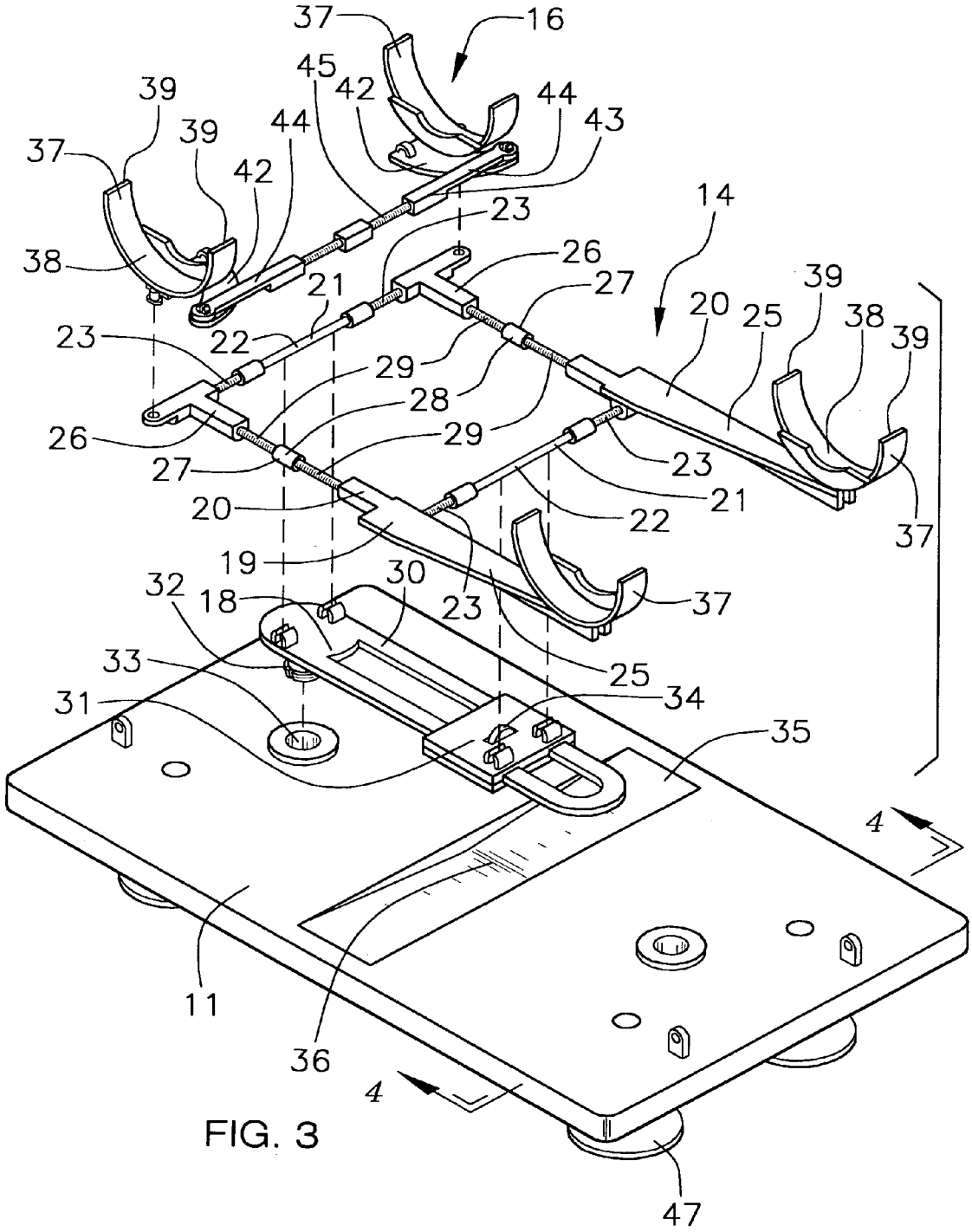
FIG. 3 is a expanded view of the present invention.
Figure 4:
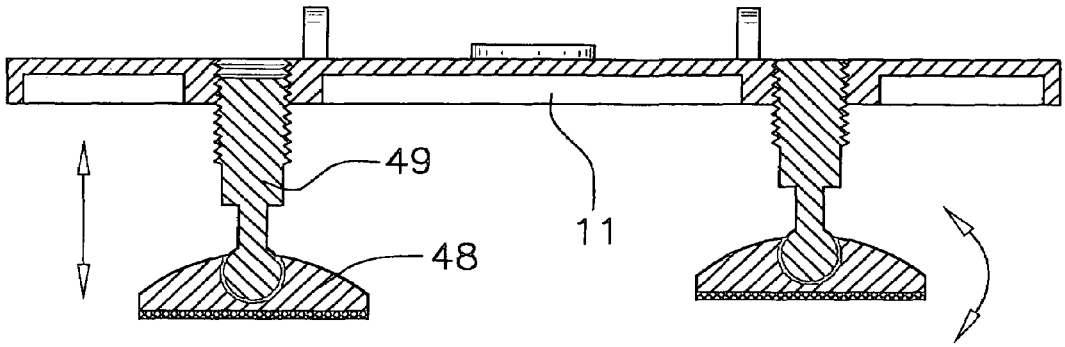
FIG. 4 is a cross-sectional view of the present invention.
Figure 5:
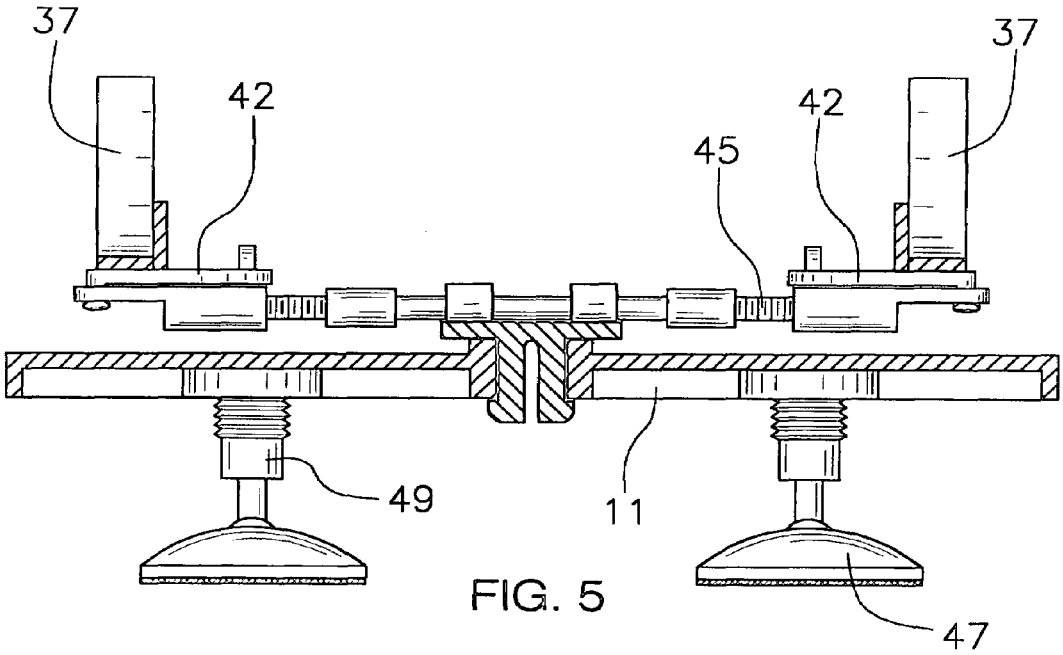
FIG. 5 is a cross-sectional view of the present invention.
Figure 6:
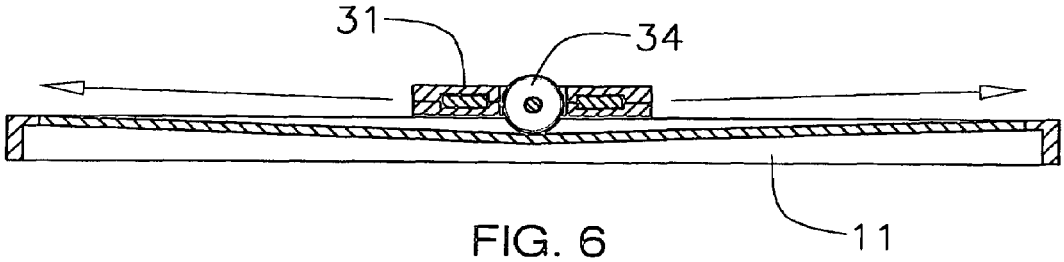
FIG. 6 is a cross-sectional view of the present invention.
Figure 7:
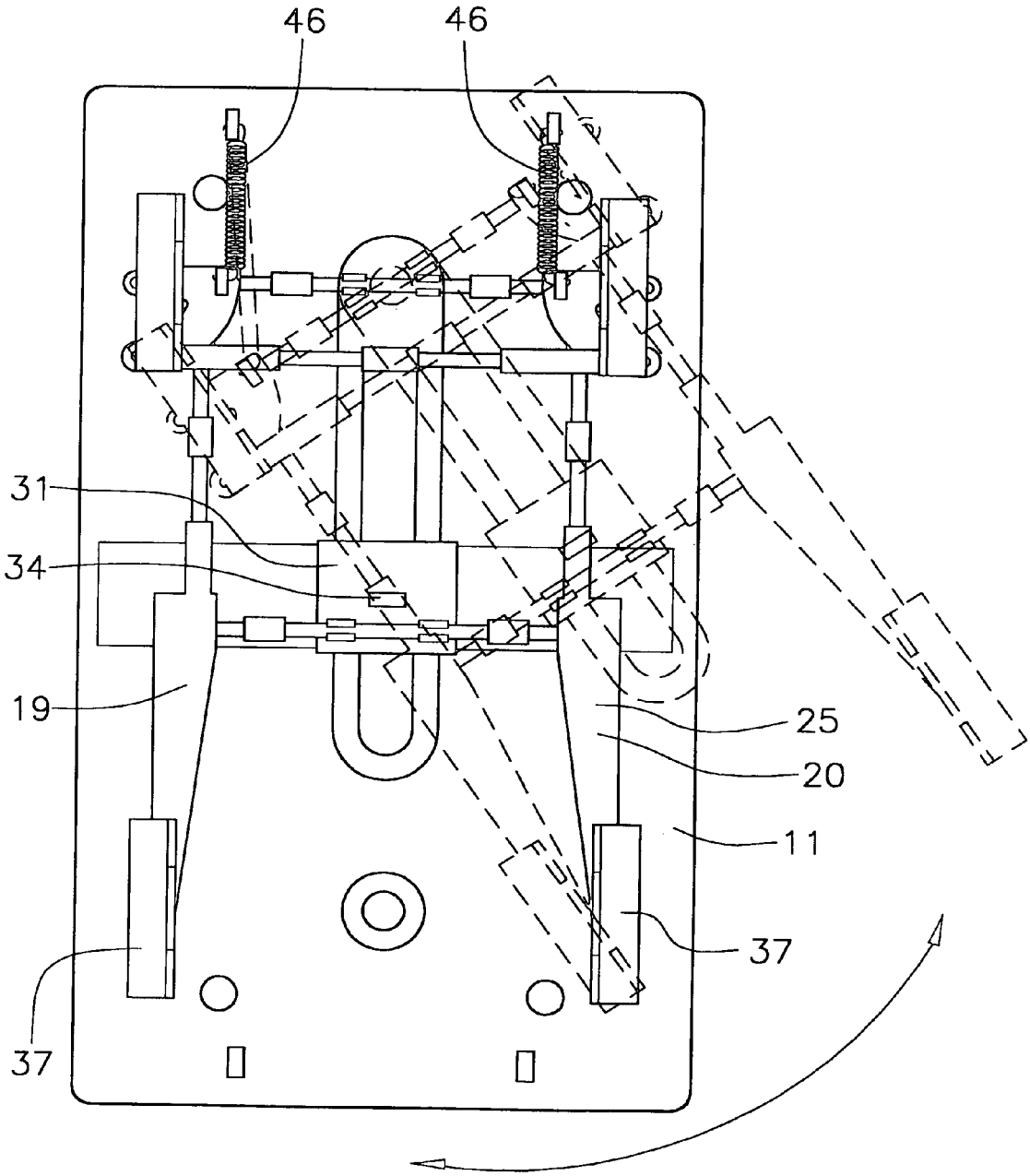
FIG. 7 is a top view of the present invention.
Figure 8:
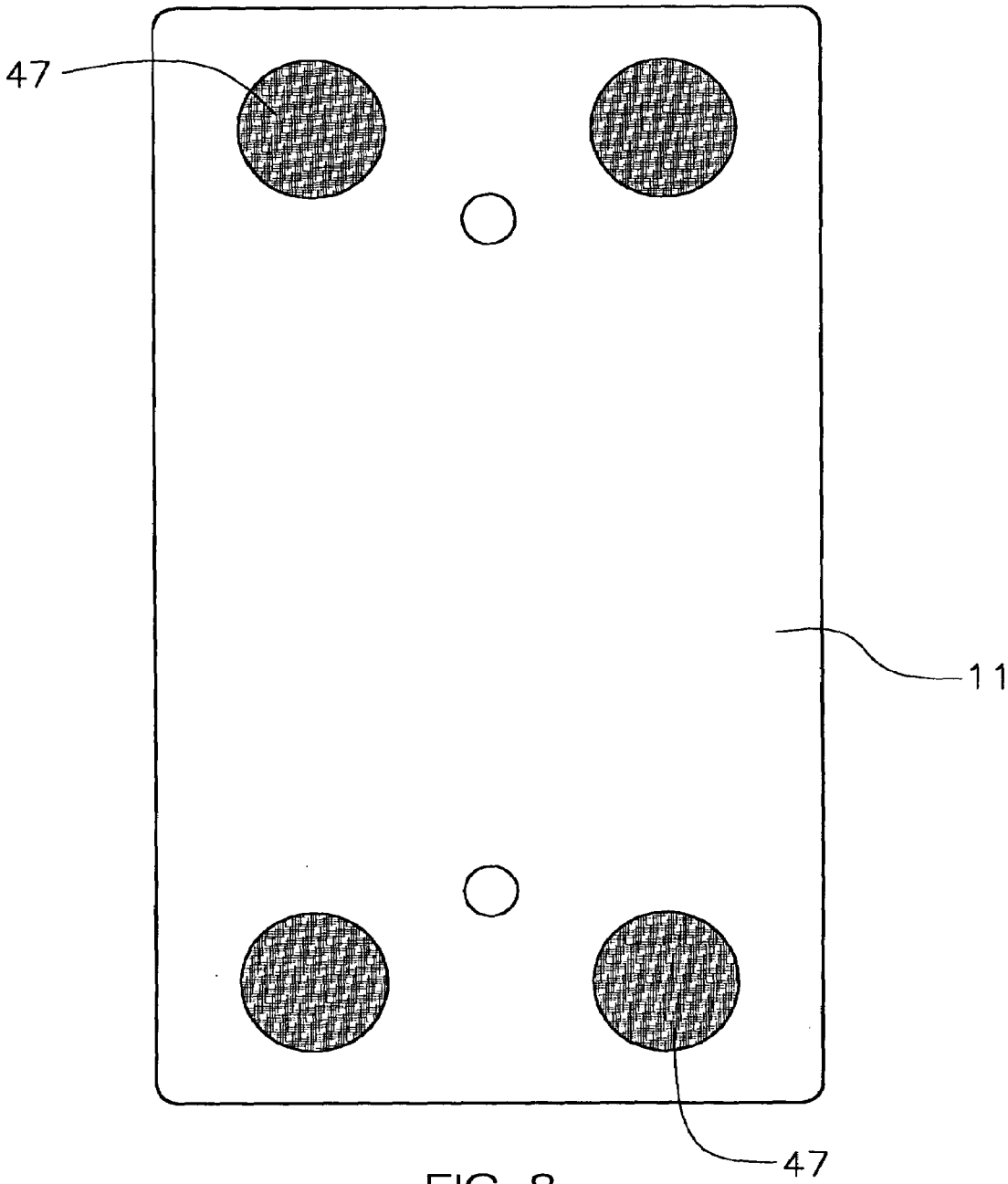
FIG. 8 is a top view of the present invention.
Figure 9:
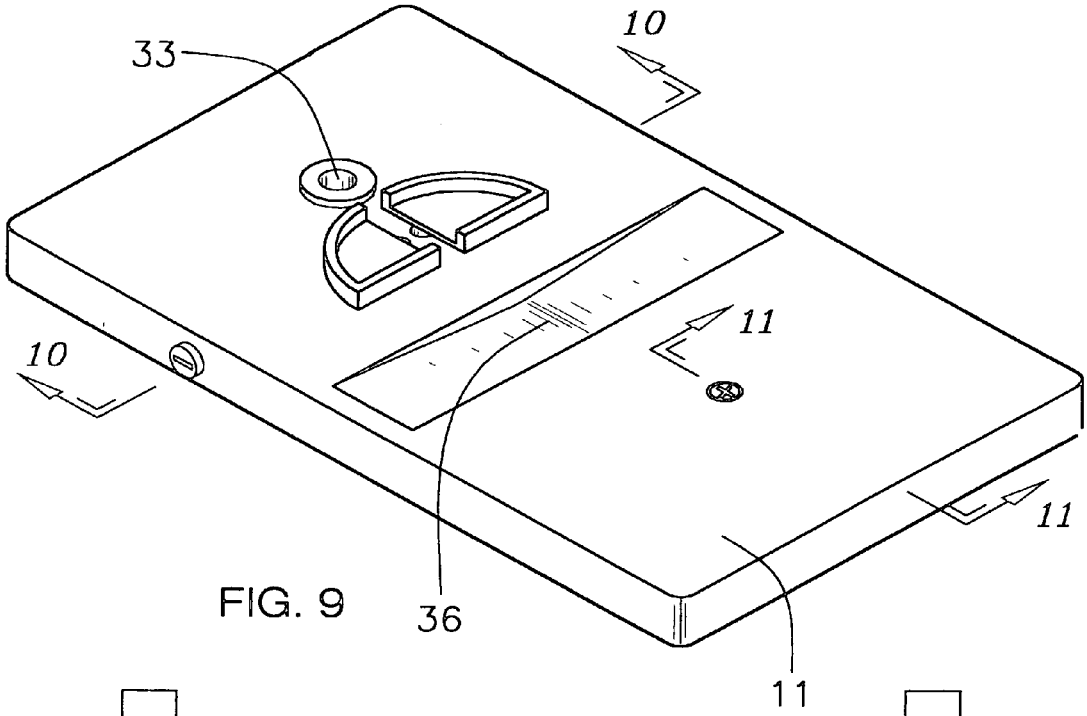
FIG. 9 is a perspective view of the present invention.
Figure 10:
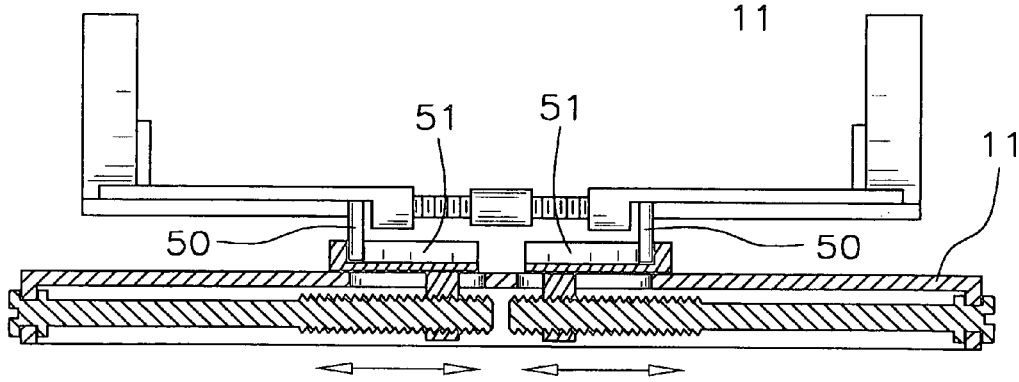
FIG. 10 is a cross-sectional view of the present invention.
Figure 11:
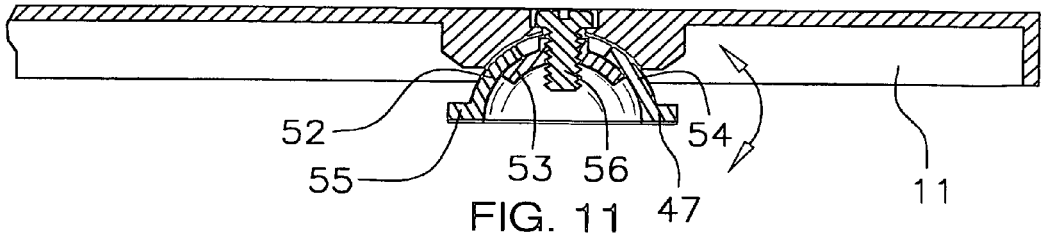
FIG. 11 is a cross-sectional view of the present invention.
Figure 12:
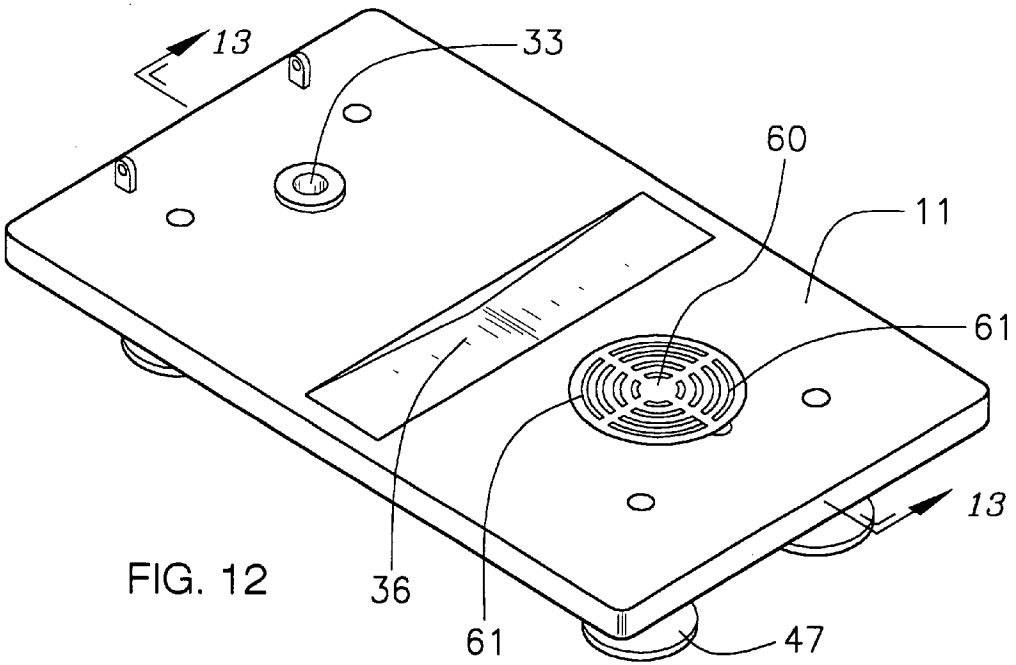
FIG. 12 is a perspective view of the present invention.
Figure 13:
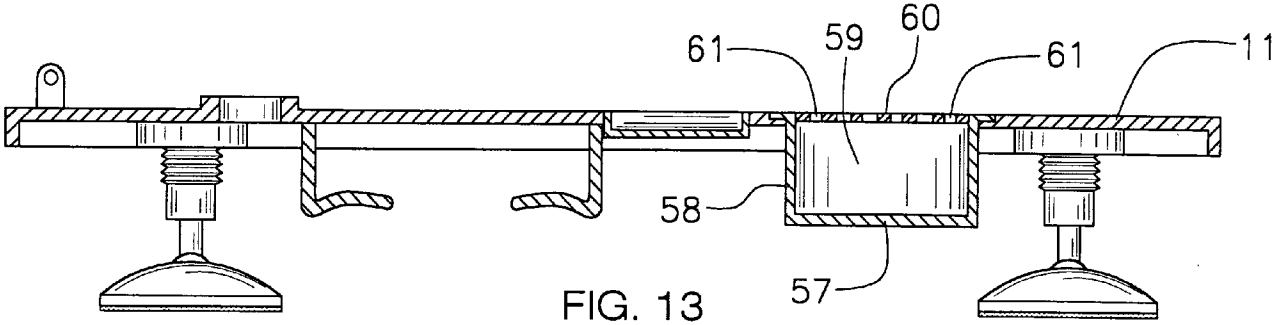
FIG. 13 is a cross-sectional view of the present invention.

With reference now to the drawings, and in particular to FIGS. 1 through 6 thereof, a new model display stand system embodying the principles and concepts of the present invention and generally designated by the reference numeral 10 will be described.

As best illustrated in FIGS. 1 through 6, the model display stand system 10 generally comprises a platform portion 11 that is designed to be coupled to the dashboard 12 of the vehicle. The platform portion 11 is designed for receiving the model 13 such that the platform portion 11 is designed for supporting the model 13 above the dashboard 12 of the vehicle. A frame assembly 14 is pivotally coupled to the platform portion 11. The frame assembly 14 is designed for selectively engaging the rear wheels 15 of the model 13 such that the frame assembly 14 is designed for permitting the model 13 to pivot with respect to the platform portion 11 when the vehicle is turning. A steering assembly 16 is pivotally coupled to the frame assembly 14. The steering assembly 16 is designed to be coupled to the front wheels 17 of the model 13. The steering assembly 16 is designed for pivoting the front wheels 17 of the model 13 to correspond to the front wheels 17 of the vehicle when the vehicle is turning.

The frame assembly 14 includes a pivot portion 18 and a engagement portion 19. The pivot portion 18 is pivotally coupled to the platform portion 11. The engagement portion 19 is coupled to the pivot portion 18. The engagement portion 19 is designed for receiving the rear wheels 15 of the model 13. The engagement portion 19 includes a pair of side members 20 and a plurality of width adjustment members 21. The width adjustment members 21 are coupled between the side members 20. Each of the side members 20 is designed to be coupled to one of the rear wheels 15 of the model 13. The width adjustment members 21 are for varying a distance between the side members 20 for accommodating models 13 having varying widths.

Each the width adjustment members 21 includes a main portion 22 and a pair of engaging ends 23. Each of the engaging ends 23 is coupled to the main portion 22 such that one of the engaging ends 23 is positioned opposite the other of the engaging ends 23. Each of the engaging ends 23 threadbly engages one of the side members 20 such that rotation of the main portion 22 of each of the width adjustment assemblies 21 rotates each of the engaging ends 23 of the associated one of the width adjustment members 21 for varying the distance between the side members 20.

Each of the side members 20 includes a rear portion 25, a front portion 26 and a length adjustment member 27. The length adjustment member 27 is coupled between the front portion 26 and the rear portion 25 such that the length adjustment member 27 selectively adjusts a length between the front portion 26 and the rear portion 25. The front portion 26 of each of the side members 20 pivotally coupling the steering assembly 16. The rear portion 25 is designed for selectively receiving one of the rear wheels 15 of the model 13.

The length adjustment member 27 of each of the side members 20 includes a base portion 28 and a pair of adjusting ends 29. The adjusting ends 29 is oppositely positioned on opposing sides of the base portion 28. One of the adjusting ends 29 is threadably coupled to the front portion 26 of the associated one of the side members 20 such that the other of the adjusting ends 29 is threadably couple to the rear portion 25 of the associated one of the side members 20. The base portion 28 is rotatable for rotating the adjusting ends 29 for adjusting a distance between the front portion 26 and the rear portion 25 of the associated one of the side members 20.

The pivot portion 18 of the frame assembly 14 includes a bar member 30 and an sleeve member 31. The sleeve member 31 is slidably coupled to the bar member 30 such that the sleeve member 31 is positionable along a length of the bar member 30. The bar member 30 and the sleeve member 31 are coupled to the engagement portion 19. The pivot portion 18 includes a locking member 32. The locking member 32 is coupled to the bar member 30. The locking member 32 is selectively inserted into an aperture 33 of the platform portion 11 for pivotally coupling the bar member 30 to the platform portion 11. The pivot portion 18 of the frame assembly 14 includes a wheel member 34. The wheel member 34 is rotatably coupled to the sleeve member 31 of the pivot portion 18. The wheel member 34 engaging a channel 35 in the platform portion 11 such that the wheel member 34 rolls along a bottom wall 36 of the channel 35 of the platform portion 11 when the frame assembly 14 pivots with respect to the platform portion 11. The bottom wall 36 of the channel 35 of the platform portion 11 is substantially u-shaped such that the wheel member 34 of the pivot portion 18 will roll down to an apex of the bottom wall 36 to return the frame assembly 14 to an aligned position with the platform portion 11 when the vehicle has ceased turning.

A plurality of arcuate engaging members 37 are coupled to the frame assembly 14 and the steering assembly 16. Each of the arcuate engaging members 37 is designed for selectively cradling one of the wheels of the model 13 for inhibiting rolling of the wheels of the model 13.

Each of the arcuate engaging members 37 includes a medial portion 38 and a pair of free ends 39. The medial portion 38 is positioned between the free ends 39 such that the free ends 39 are positioned opposite the platform portion 11 when the medial portion 38 of each of the arcuate engaging members 37 is coupled to the associated the frame assembly 14 and the steering assembly 16. The medial portion 38 of each of the arcuate engaging members 37 is designed for receiving one of the wheels 41 of the model 13 such that the free ends 39 are positioned along a tread face of the associated one of the wheels for inhibiting rolling of the wheel.

The steering assembly 16 includes a pair of end members 42 and an arm member 43. The arm member 43 is pivotally coupled to the end members 42 such that pivoting of one of the end members 42 with respect to the frame assembly 14 the other of the end members 42 is pivoted with respect to the frame assembly 14. Each of the end members 42 is pivotally coupled to the frame assembly 14. The arm member 43 is for adjusting a distance between the end members 42.

The arm member 43 includes a pair of armature portions 44 and a rod portion 45. The rod portion 45 threadably engages each of the armature portions 44 such that rotation of the rod portion 45 with respect to the armature portions 44 adjusts a distance between the armature portions 44. Each of the armature portions 44 is coupled to one of the end members 42 for transferring pivotal movement of one of the end members 42 to the other one of the end members 42.

The steering assembly 16 includes a pair of biasing members 46. Each of the biasing members 46 is coupled between one of the end members 42 and the platform portion 11. Each of the biasing members 46 is for biasing the associated one of the end members 42 to a neutral position when the vehicle has finished the turn.

A plurality of mounting portions 47 are coupled to the platform portion 11. Each of the mounting portions 47 is designed to be coupled to the dashboard 12 of the vehicle such that the mounting portion 47 is designed for securing the platform portion 11 to the dashboard 12 of the vehicle.

Each of the mounting portions 47 includes a foot member 48 and stanchion member 49. The foot member 48 is pivotally coupled to the stanchion member 49 such that the foot member 48 is designed for coupling to an non-level portion of the dashboard 12 while maintaining a substantially vertical orientation of the stanchion member 49. The stanchion member 49 is threadably coupled to the platform portion 11 such that rotation of the stanchion member 49 with respect to the platform portion 11 adjusts a distance between the platform portion 11 and the foot member 48 of the associated one of the mounting portions 47.

In an embodiment the steering assembly 16 includes a pair of guide members 50. Each of the guide members 50 is coupled to one of the end members 42. Each of the guide members 50 of the steering assembly 16 engages one of a pair of cam members 51 coupled to the platform portion 11 such that the cam members 51 are for controlling pivoting of the end members 42 of the steering assembly 16 for altering the angle of the front wheel 17 of the model 13 when the vehicle is turning.

In an embodiment the mounting portion 47 includes a domed member 52 and a compression member 53. The domed member 52 includes an arcuate portion 54 and a flat portion 55. The flat portion 55 of the domed member 52 is adapted for is coupled to the dashboard 12 of the vehicle. The arcuate portion 54 of the domed member 52 is positioned in an hemispherical recess of the platform portion 11 for permitting changing of an orientation of the platform portion 11 with respect to the domed member 52. The compression member 53 is positioned in the domed member 52 opposite the platform portion 11. The mounting portion 47 includes a threaded member 56 extending through the platform portion 11 and engaging the compression member 53. The threaded member 56 is rotatable in a first direction for drawing the compression member 53 towards the platform portion 11 to compress the domed member 52 between the compression member 53 and the platform portion 11 for securing the platform portion 11 in the desired orientation. The threaded member 56 is rotatable in a second direction for pushing the compression member 53 away from the platform portion 11 to permit changing of orientation of the platform portion 11 with respect to the domed member 52.

In an embodiment a scent housing 57 includes a perimeter wall 58. The perimeter wall 58 of the scent housing 57 defines a bore 59 of the scent housing 57. The perimeter wall 58 of the scent housing 57 is coupled to the platform portion 11 such that the bore 59 of the scent housing 57 extends through the platform portion 11. The bore 59 of the scent housing 57 is adapted for receiving scent emitting objects to scent the air of the vehicle. A lid member 60 is selectively coupled to the perimeter wall 58 of the scent housing 57 for closing the bore 59 of the scent housing 57. The lid member 60 has plurality of scenting apertures 61 such that the scenting apertures 61 are adapted for permitting scent emitted by the scent emitting objects to be dispersed into the vehicle.

In use, the present invention would be mounted on the dashboard of a vehicle. The present invention would mimic the movements of the vehicle when the vehicle is driven.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A model display stand system for mounting to a dashboard of a vehicle that will cause wheels of a model to imitate the actions of the vehicle while the vehicle is being driven, the model display stand system comprising:

a platform portion being adapted for being coupled to the dashboard of the vehicle, said platform portion being adapted for receiving the model such that said platform portion is adapted for supporting the model above the dashboard of the vehicle;

a frame assembly being pivotally coupled to said platform portion, said frame assembly being adapted for selectively engaging the rear wheels of the model such that said frame assembly is adapted for permitting the model to pivot with respect to said platform portion when the vehicle is turning; and a steering assembly being pivotally coupled to said frame assembly, said steering assembly being adapted for being coupled to the front wheels of the model, said steering assembly being adapted for pivoting the front wheels of the model to correspond to the front wheels of the vehicle when the vehicle is turning.

2. The model display stand system as set forth in claim 1, further comprising:

said frame assembly comprising a pivot portion and a engagement portion, said pivot portion being pivotally coupled to said platform portion, said engagement portion being coupled to said pivot portion, said engagement portion being adapted for receiving the rear wheels of the model.

3. The model display stand system as set forth in claim 2, further comprising:

said engagement portion comprising a pair of side members and a plurality of width adjustment members, said width adjustment members being coupled between said side members, each of said side members being adapted for being coupled to one of the rear wheels of the model, said width adjustment members being for varying a distance between said side members for accommodating models having varying widths.

4. The model display stand system as set forth in claim 3, further comprising:

each said width adjustment members comprising a main portion and a pair of engaging ends, each of said engaging ends being coupled to said main portion such that one of said engaging ends is positioned opposite the other of said engaging ends, each of said engaging ends threadbly engaging one of said side members such that rotation of said main portion of each of said adjustment assemblies rotates each of said engaging ends of the associated one of said width adjustment members for varying the distance between said side members.

5. The model display stand system as set forth in claim 3, further comprising:

each of said side members comprising a rear portion, a front portion and a length adjustment member, said length adjustment member being coupled between said front portion and said rear portion such that said length adjustment member selectively adjusts a length between said front portion and said rear portion, said front portion of each of said side members pivotally coupling said steering assembly, said rear portion being adapted for selectively receiving one of the rear wheels of the model.

6. The model display stand system as set forth in claim 5, further comprising:

said length adjustment member of each of said side members comprising a base portion and a pair of adjusting ends, said adjusting ends being oppositely positioned on opposing sides of said base portion, one of said adjusting ends being threadably coupled to said front portion of the associated one of said side member such that the other of said adjusting ends is threadably couple to said rear portion of the associated one of said side members, said base portion being rotatable for rotating said adjusting ends for adjusting a distance between said front portion and said rear portion of the associated one of said side members.

7. The model display stand system as set forth in claim 3, further comprising:

said pivot portion of said frame assembly comprising a bar member and an sleeve member, said sleeve member being slidably coupled to said bar member such that said sleeve member is positionable along a length of said bar member, said bar member and said sleeve member being coupled to said engagement portion, said pivot portion comprising a locking member, said locking member being coupled to said bar member, said locking member being selectively inserted into an aperture of said platform portion for pivotally coupling said bar member to said platform portion.

8. The model display stand system as set forth in claim 7, further comprising:

said pivot portion of said frame assembly comprising a wheel member, said wheel member being rotatably coupled to said sleeve member of said pivot portion, said wheel member engaging a channel in said platform portion such that said wheel member rolls along a bottom wall of said channel of said platform portion when said frame assembly pivots with respect to said platform portion, said bottom wall of said channel of said platform portion being substantially u-shaped such that said wheel member of said pivot portion will roll down to an apex of said bottom wall to return said frame assembly to an aligned position with said platform portion when the vehicle has ceased turning.

9. The model display stand system as set forth in claim 1, further comprising:

a plurality of arcuate engaging members being coupled to said frame assembly and said steering assembly, each of said arcuate engaging member being adapted for selectively cradling one of the wheels of the model for inhibiting rolling of the wheels of the model.

10. The model display stand system as set forth in claim 9, further comprising:

each of said arcuate engaging members comprising a medial portion and a pair of free ends, said medial portion being positioned between said free ends such that said free ends are positioned opposite said platform portion when said medial portion of each of said arcuate engaging members is coupled to the associated said frame assembly and said steering assembly, said medial portion of each of said arcuate engaging members being adapted for receiving one of the wheels of the model such that said free ends are positioned along a tread face of the associated one of the wheels for inhibiting rolling of the wheel.

11. The model display stand system as set forth in claim 1, further comprising:

said steering assembly comprising a pair of end members and an arm member, said arm member being pivotally coupled to said end members such that pivoting of one of said end members with respect to said frame assembly the other of said end members is pivoted with respect to said frame assembly, each of said end members being pivotally coupled to said frame member, said arm member being for adjusting a distance between said end members.

12. The model display stand system as set forth in claim 11, further comprising:

said arm member comprising a pair of armature portions and a rod portion, said rod portion threadably engaging each of said armature portions such that rotation of said rod portion with respect to said armature portions adjusts a distance between said armature portions, each of said armature portions being coupled to one of said end members for transferring pivotal movement of one of said end members to the other one of said end members.

13. The model display stand system as set forth in claim 11, further comprising:

said steering assembly comprising a pair of biasing members, each of said biasing members being coupled between one of said end members and said platform portion, each of said biasing members being for biasing the associated one of said end members to a neutral position when the vehicle has finished the turn.

14. The model display stand system as set forth in claim 11, further comprising:

said steering assembly comprising a pair of guide members, each of said guide members being coupled to one of said end members, each of said guide members of said steering assembly engaging one of a pair of cam members coupled to said platform portion such that said cam members are for controlling pivoting of said end members of said steering assembly for altering the angle of the front wheel of the model when the vehicle is turning.

15. The model display stand system as set forth in claim 1, further comprising:

at least one mounting portion being coupled to said platform portion, said mounting portion being adapted for coupling to the dashboard of the vehicle such that said mounting portion is adapted for securing said platform portion to the dashboard of the vehicle.

16. The model display stand system as set forth in claim 15, further comprising:

said mounting portion comprising a foot member and stanchion member, said foot member being pivotally coupled to said stanchion portion such that said foot member is adapted for coupling to an non-level portion of the dashboard while maintaining a substantially vertical orientation of said stanchion member, said stanchion member being threadably coupled to said platform member such that rotation of said stanchion member with respect to said platform portion adjusts a distance between said platform portion and said foot member.

17. The model display stand system as set forth in claim 15, further comprising:

said mounting portion comprising a domed member and a compression member, said domed member comprising an arcuate portion and a flat portion, said flat portion of said domed member being adapted for being coupled to the dashboard of the vehicle, said arcuate portion of said domed member being positioned in an hemispherical recess of said platform portion for permitting changing of an orientation of said platform portion with respect to said domed member, said compression member being positioned in said domed member opposite said platform portion, said mounting portion comprising a threaded member extending through said platform portion and engaging said compression member, said threaded member being rotatable in a first direction for drawing said compression member towards said platform portion to compress said domed member between said compression member and said platform portion for securing said platform member in the desired orientation, said threaded member being rotatable in a second direction for pushing said compression member away from said platform portion to permit changing of orientation of said platform portion with respect to said domed member.

18. The model display stand system as set forth in claim 1, further comprising:

a scent housing comprising a perimeter wall, said perimeter wall of said scent housing defining a bore of said scent housing, said perimeter wall of said scent housing being coupled to said platform portion such that said bore of said scent housing extends through said platform portion, said bore of said scent housing being adapted for receiving scent emitting objects to scent the air of the vehicle; and a lid member being selectively coupled to said perimeter wall of said scent housing for closing said bore of said scent housing, said lid member having plurality of scenting apertures such that said scenting apertures are adapted for permitting scent emitted by the scent emitting objects to be dispersed into the vehicle.

19. A model display stand system for mounting to a dashboard of a vehicle that will cause wheels of a model to imitate the actions of the vehicle while the vehicle is being driven, the model display stand system comprising:

a platform portion being adapted for being coupled to the dashboard of the vehicle, said platform portion being adapted for receiving the model such that said platform portion is adapted for supporting the model above the dashboard of the vehicle;

a frame assembly being pivotally coupled to said platform portion, said frame assembly being adapted for selectively engaging the rear wheels of the model such that said frame assembly is adapted for permitting the model to pivot with respect to said platform portion when the vehicle is turning;

a steering assembly being pivotally coupled to said frame assembly, said steering assembly being adapted for being coupled to the front wheels of the model, said steering assembly being adapted for pivoting the front wheels of the model to correspond to the front wheels of the vehicle when the vehicle is turning;

said frame assembly comprising a pivot portion and a engagement portion, said pivot portion being pivotally coupled to said platform portion, said engagement portion being coupled to said pivot portion, said engagement portion being adapted for receiving the rear wheels of the model;

said engagement portion comprising a pair of side members and a plurality of width adjustment members, said width adjustment members being coupled between said side members, each of said side members being adapted for being coupled to one of the rear wheels of the model, said width adjustment members being for varying a distance between said side members for accommodating models having varying widths;

each said width adjustment members comprising a main portion and a pair of engaging ends, each of said engaging ends being coupled to said main portion such that one of said engaging ends is positioned opposite the other of said engaging ends, each of said engaging ends threadbly engaging one of said side members such that rotation of said main portion of each of said adjustment assemblies rotates each of said engaging ends of the associated one of said width adjustment members for varying the distance between said side members;

each of said side members comprising a rear portion, a front portion and a length adjustment member, said length adjustment member being coupled between said front portion and said rear portion such that said length adjustment member selectively adjusts a length between said front portion and said rear portion, said front portion of each of said side members pivotally coupling said steering assembly, said rear portion being adapted for selectively receiving one of the rear wheels of the model;

said length adjustment member of each of said side members comprising a base portion and a pair of adjusting ends, said adjusting ends being oppositely positioned on opposing sides of said base portion, one of said adjusting ends being threadably coupled to said front portion of the associated one of said side member such that the other of said adjusting ends is threadably couple to said rear portion of the associated one of said side members, said base portion being rotatable for rotating said adjusting ends for adjusting a distance between said front portion and said rear portion of the associated one of said side members;

said pivot portion of said frame assembly comprising a bar member and an sleeve member, said sleeve member being slidably coupled to said bar member such that said sleeve member is positionable along a length of said bar member, said bar member and said sleeve member being coupled to said engagement portion, said pivot portion comprising a locking member, said locking member being coupled to said bar member, said locking member being selectively inserted into an aperture of said platform portion for pivotally coupling said bar member to said platform portion;

said pivot portion of said frame assembly comprising a wheel member, said wheel member being rotatably coupled to said sleeve member of said pivot portion, said wheel member engaging a channel in said platform portion such that said wheel member rolls along a bottom wall of said channel of said platform portion when said frame assembly pivots with respect to said platform portion, said bottom wall of said channel of said platform portion being substantially unshaped such that said wheel member of said pivot portion will roll down to an apex of said bottom wall to return said frame assembly to an aligned position with said platform portion when the vehicle has ceased turning;

a plurality of arcuate engaging members being coupled to said frame assembly and said steering assembly, each of said arcuate engaging member being adapted for selectively cradling one of the wheels of the model for inhibiting rolling of the wheels of the model;

each of said arcuate engaging members comprising a medial portion and a pair of free ends, said medial portion being positioned between said free ends such that said free ends are positioned opposite said platform portion when said medial portion of each of said arcuate engaging members is coupled to the associated said frame assembly and said steering assembly, said medial portion of each of said arcuate engaging members being adapted for receiving one of the wheels of the model such that said free ends are positioned along a tread face of the associated one of the wheels for inhibiting rolling of the wheel;

said steering assembly comprising a pair of end members and an arm member, said arm member being pivotally coupled to said end members such that pivoting of one of said end members with respect to said frame assembly the other of said end members is pivoted with respect to said frame assembly, each of said end members being pivotally coupled to said frame member, said arm member being for adjusting a distance between said end members;

said arm member comprising a pair of armature portions and a rod portion, said rod portion threadably engaging each of said armature portions such that rotation of said rod portion with respect to said armature portions adjusts a distance between said armature portions, each of said armature portions being coupled to one of said end members for transferring pivotal movement of one of said end members to the other one of said end members;

said steering assembly comprising a pair of biasing members, each of said biasing members being coupled between one of said end members and said platform portion, each of said biasing members being for biasing the associated one of said end members to a neutral position when the vehicle has finished the turn;

a plurality of mounting portions being coupled to said platform portion, each of said mounting portions being adapted for coupling to the dashboard of the vehicle such that said mounting portion is adapted for securing said platform portion to the dashboard of the vehicle; and each of said mounting portions comprising a foot member and stanchion member, said foot member being pivotally coupled to said stanchion portion such that said foot member is adapted for coupling to an non-level portion of the dashboard while maintaining a substantially vertical orientation of said stanchion member, said stanchion member being threadably coupled to said platform member such that rotation of said stanchion member with respect to said platform portion adjusts a distance between said platform portion and said foot member of the associated one of said mounting portions.

20. The model display stand system as set forth in claim 19, further comprising:

a scent housing comprising a perimeter wall, said perimeter wall of said scent housing defining a bore of said scent housing, said perimeter wall of said scent housing being coupled to said platform portion such that said bore of said scent housing extends through said platform portion, said bore of said scent housing being adapted for receiving scent emitting objects to scent the air of the vehicle; and a lid member being selectively coupled to said perimeter wall of said scent housing for closing said bore of said scent housing, said lid member having plurality of scenting apertures such that said scenting apertures are adapted for permitting scent emitted by the scent emitting objects to be dispersed into the vehicle.

* * * * *